US006564427B1

(12) United States Patent
Flegel

(10) Patent No.: US 6,564,427 B1
(45) Date of Patent: May 20, 2003

(54) HINGED ASSEMBLY FOR COVER ARRANGEMENT IN POWER INLET BOX

(75) Inventor: David D. Flegel, Racine, WI (US)

(73) Assignee: Reliance Time Controls, Inc., Racine, WI (US)

( * ) Notice: Subject to any disclaimer, the term of this patent is extended or adjusted under 35 U.S.C. 154(b) by 177 days.

(21) Appl. No.: 09/794,806

(22) Filed: Feb. 27, 2001

(51) Int. Cl.[7] ..... E05F 1/14

(52) U.S. Cl. ..... 16/285; 16/280; 16/304; 16/307; 16/308; 29/434

(58) Field of Search ..... 16/280, 285, 304, 16/307, 308; 29/434

(56) References Cited

U.S. PATENT DOCUMENTS

| | | | | | |
|---|---|---|---|---|---|
| 1,131,667 | A | * | 3/1915 | Bommer | 16/279 |
| 2,856,470 | A | | 10/1958 | Hyde | |
| 3,277,251 | A | | 10/1966 | Daly | |
| 3,284,591 | A | | 11/1966 | Daly | |
| 3,315,556 | A | | 4/1967 | Speck | |
| 3,361,938 | A | | 1/1968 | Watson | |
| 3,391,374 | A | | 7/1968 | Schleicher | |
| 3,523,166 | A | | 8/1970 | Daly | |
| 3,559,148 | A | | 1/1971 | Hafer | |
| 3,636,237 | A | | 1/1972 | Hafer | |
| 3,654,484 | A | | 4/1972 | Jorgenson et al. | |
| 3,716,683 | A | | 2/1973 | Hafer | |
| 3,723,942 | A | | 3/1973 | Donalson | |
| 3,731,256 | A | | 5/1973 | Hafer | |
| 3,739,321 | A | | 6/1973 | Murphy et al. | |
| 3,742,431 | A | | 6/1973 | Kobyner | |
| 3,781,765 | A | | 12/1973 | Schleicher | |
| 3,922,053 | A | | 11/1975 | Hafer | |
| 4,058,358 | A | | 11/1977 | Carlisle | |
| 4,067,529 | A | | 1/1978 | Milcoy | |
| 4,088,829 | A | | 5/1978 | Milcoy | |
| 4,282,954 | A | | 8/1981 | Hill | |
| 4,605,817 | A | | 8/1986 | Lopez | |
| 5,070,252 | A | | 12/1991 | Castenschiold et al. | |
| 5,174,773 | A | | 12/1992 | Jones | |
| 5,265,511 | A | * | 11/1993 | Itzov | 83/490 |
| 5,268,850 | A | | 12/1993 | Skoglund | |
| 5,402,323 | A | | 3/1995 | Schwenk et al. | |
| 5,579,201 | A | | 11/1996 | Karageozian | |
| 5,590,440 | A | * | 1/1997 | Pelt et al. | 16/429 |
| 5,717,164 | A | | 2/1998 | Shetterly | |
| 5,773,757 | A | | 6/1998 | Kenney et al. | |
| 5,984,719 | A | | 11/1999 | Flegel | |
| 6,148,480 | A | * | 11/2000 | Cooke | 16/303 |
| 6,276,027 | B1 | * | 8/2001 | Hanna | 16/436 |

* cited by examiner

*Primary Examiner*—Anthony Knight
*Assistant Examiner*—Enoch Peavey
(74) *Attorney, Agent, or Firm*—Andrus, Sceales, Starke & Sawall, LLP

(57) ABSTRACT

A hinge construction for pivotably connecting a pair of members together, such as for connecting the access cover of a power inlet box used in connecting an auxiliary generator to the electrical system of a building. The construction includes a mounting member including a knuckle fixed to the power inlet box. An access member includes a pair of spaced apart, pivot lugs disposed one on each side of the knuckle for movement between a closed position in which the access cover engages the mounting member to prevent access to the power inlet box, and an open position for providing access to the power inlet box. A hinge pin passes through aligned apertures in the mounting member knuckle and the access cover lugs, and forms a rotational axis about which the access cover pivots. A torsion spring surrounds the hinge pin and has a first end retained in the mounting member knuckle and a second end disposed outside the access cover lugs. An end cap is attached to one end of the hinge pin and has tab structure for retaining the second end of the spring, and a notched, peripheral structure enabling the end cap, the hinge pin and the spring to be rotated together as a unit such that the second end of the spring is placed in a retaining slot formed in the one access cover lug. The spring is thus wound so that the access cover is normally biased in the closed position against the mounting member.

14 Claims, 4 Drawing Sheets

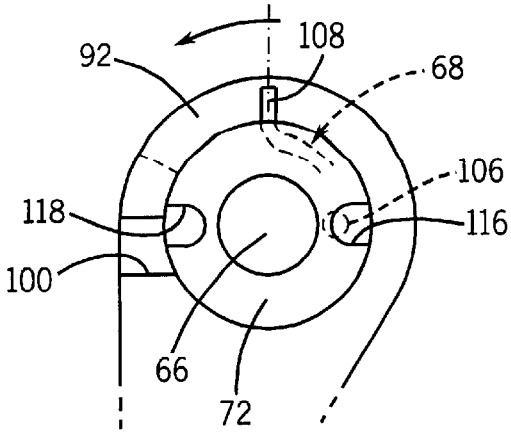
FIG. 7
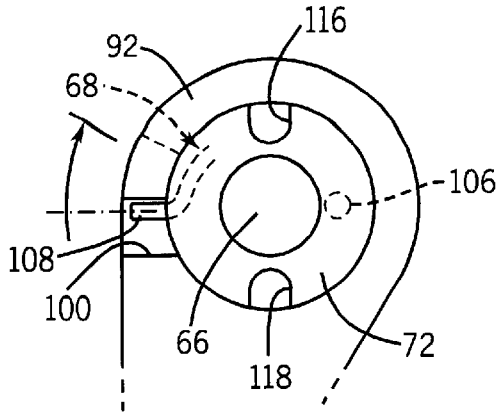
FIG. 8
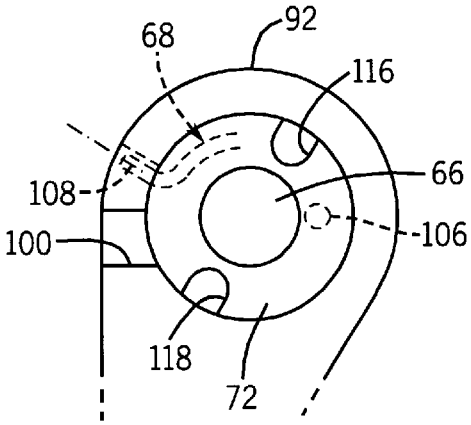
FIG. 9
FIG. 10
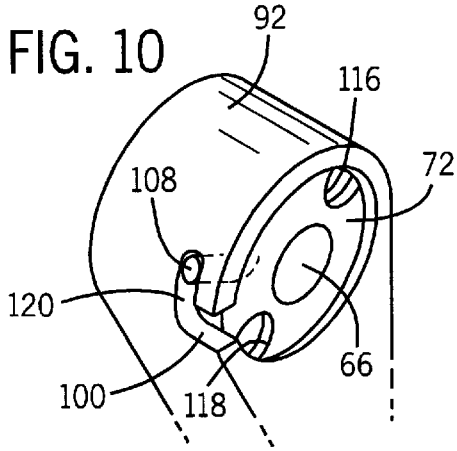
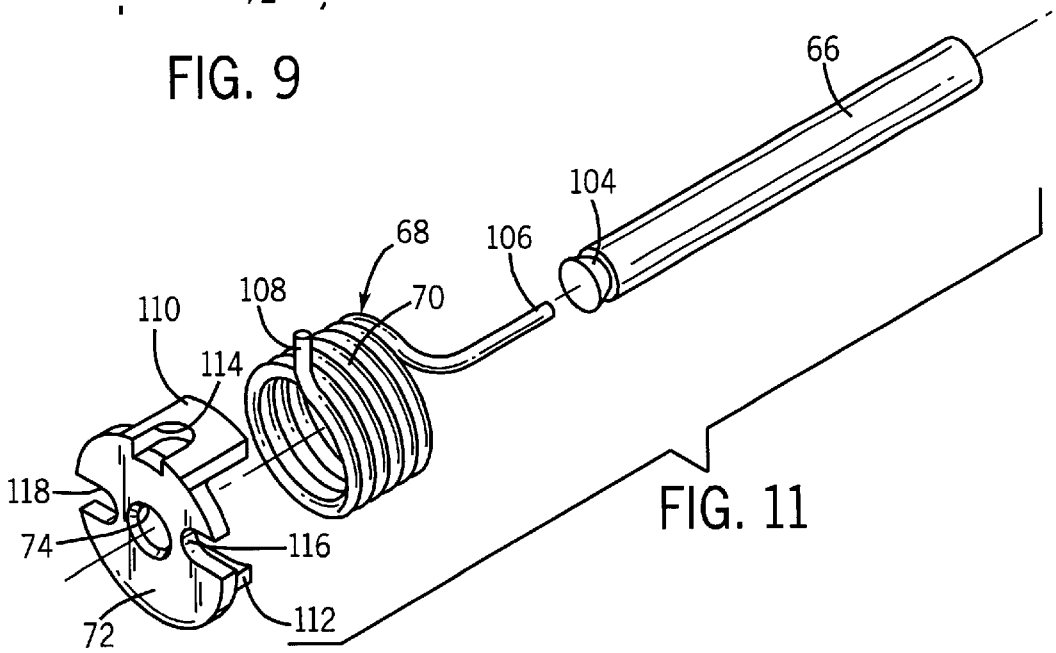
FIG. 11

HINGED ASSEMBLY FOR COVER ARRANGEMENT IN POWER INLET BOX

FIELD OF THE INVENTION

This invention relates broadly to a power inlet box used in providing power to an electrical system of a building in the event of a power outage or the like, and more particularly, pertains to installation of a biased, hinged cover arrangement for selectively preventing and allowing access to the interior of the power inlet box.

BACKGROUND AND SUMMARY OF THE INVENTION

In an auxiliary power supply system, a remote power generator is interconnected with a power inlet box which is typically mounted to the exterior of a building. The power inlet box is, in turn, interconnected with a manual transfer switching arrangement, which is connected to the main electrical panel or load center of the building. A cord is interconnected with the power outlet of the generator and with a power inlet receptacle associated with the power inlet box for providing power from the generator through the power inlet box to the manual transfer panel, and ultimately to the main electrical panel in order to supply power to certain circuits of the building in the event of a power outage or the like.

Prior art power inlet boxes are comprised of a housing or base member defining an internal cavity, and a cover assembly adapted for removable interconnection with the base member for enclosing the internal cavity. The power inlet is mounted to the cover assembly and includes a mounting member positionable within an opening formed in the cover assembly, and a power receptacle socket structure to which is attached various electrical wiring from the building. An access cover is associated with the mounting member and is pivotable between a closed position in which the access cover covers the mounting member to prevent access to the power receptacle socket structure, and an open position providing access to the power receptacle socket structure. The details of the construction set forth above are more fully described in the assignee's U.S. Pat. No. 5,984,719, issued Nov. 16, 1999, which is herein incorporated by reference.

In prior art constructions, the access cover is interconnected with the mounting member via a biased, hinged mounting assembly. The mounting member has a knuckle which is fixed to the cover assembly of the power inlet box, and the access cover is provided with a pair of first and second pivot lugs which are disposed on each side of the knuckle. A headed hinge pin passes through aligned apertures in the knuckle and pivot lugs, and forms a rotational axis about which the access cover pivots. A coiled portion of a torsion spring surrounds a portion of the hinge pin and has a first end which is received in a retention groove formed axially of a passageway in the knuckle, and a second end which is disposed outside the first access cover pivot lug. The headed hinge pin and the torsion spring are provided so that the access cover is normally biased to close against the mounting member so that access to the interior of the power inlet box is prevented.

To install the prior art hinge mounting assembly, the first end of the torsion spring is inserted through an aperture of the first pivot lug and into the retention groove in the knuckle passageway. This initial step locates the coiled portion of the torsion spring in the aperture of the first pivot lug, and places the second end of the spring on the outside surface of the first pivot lug. At this point, the second end of the spring must be forcefully rotated with a tool so as to place the second end in a retaining slot formed in the wall of the first pivot lug. The effect is to wind the spring so that the access cover will normally remain biased in a closed position. However, this forceful rotation of the spring has proved to be troublesome, with the spring having a propensity to become dislodged from the pivot lug during rotation. In addition, the tool has a tendency to slip off the second end of the spring. Consequently, once the first end and the coiled portion of the spring have been located, the shaft of the hinge pin is passed through the coiled portion of the spring and through the aligned apertures in the access cover pivot lugs and the mounting member knuckle. The rounded head of the hinge pin is located outside the second end of the spring and prevents the spring from dislodging as the installer rotates the second end of the spring into the retaining slot. It is not uncommon for this sequence to require several attempts to install the spring in its mounting condition. Once this is done, the head of the hinge pin is pushed flush against the outside of the first pivot lug, so that the other end of the hinge pin projects through the aperture in the second pivot lug. A retaining ring is then fixed on the other end of the pin to hold the hinge arrangement in place. It can thus be understood that installation of the hinge assembly for a cover arrangement of a power inlet box has been problematical and inefficient.

It is one object of the present invention to provide an improved hinge construction to be interposed between the, movable access cover and the fixed mounting member in a power inlet box. It is also an object of the present invention to provide a hinge pin and torsion spring mounting arrangement having a unique end cap construction for joining the hinge pin with the torsion spring and simplifying installation. It is a further object, of the present invention to provide an improved method of installing a biased, hinged cover arrangement for a power inlet box.

In accordance with one aspect of the invention, the hinge pin and torsion spring mounting arrangement is engaged with a first component of a mounting member and second and third components of an access cover disposed on each side of the first component for pivoting the access cover relative to the mounting member. The arrangement includes a hinge pin which passes through aligned apertures formed in the first, second and third components. A torsion spring surrounds the hinge pin and has a first end retained in the mounting member first component, and a second end disposed outside one of the access cover second and third components. An end cap is constructed and arranged to be attached to one end of the hinge pin and the second end of the spring enabling the end cap, the hinge pin and the spring to be moved together such that the second end of the spring is placed in a retaining slot formed in one of the access cover second and third components. The spring is thus wound so that the access cover is normally biased closed against the mounting member. The hinge pin has a generally cylindrical shape having one end notched. The torsion spring includes a coiled portion received in one of the access cover second and third components. The end cap is a circular planar member having a central opening formed therein for receiving the notched end of the hinge pin. The end cap further includes a pair of tabs extending generally perpendicularly from the planar member at locations diametrically opposite each other. One of the tabs has an opening for receiving the second end of the spring. The tabs define bearing surfaces engageable with one of the access cover second and third components for maintaining the hinge pin in a centered position in the aligned apertures. The tabs partially surround the coiled portion of the spring. The end cap also has a peripheral structure formed with a pair of diametrically opposed notches adapted to be engaged by a tool to facilitate rotation of the end cap, hinge pin and spring.

In another aspect of the invention, a hinge construction is provided for a power inlet box used in connecting an auxiliary generator to the electrical system of a building. The hinge construction includes a mounting member having a knuckle fixed to the power inlet box. An access cover includes a pair of spaced apart, pivot lugs disposed on each side of the knuckle for movement between a closed position in which the access member engages the mounting member to prevent access to the power inlet box, and an open position providing access to the power inlet box. A hinge pin passes through aligned apertures in the mounting member knuckle and the access cover lugs, and forms a rotational axis about which the access cover pivots. A torsion spring surrounds the hinge pin and has a first end retained in the mounting member knuckle and a second end disposed outside one of the access cover lugs. An end cap is attached to one end of the hinge pin and has tab structure for retaining the second end of the spring, and a notched peripheral structure enabling the end cap, the hinge pin and the spring to be rotated together as a unit, such that the second end of the spring is placed in a retaining slot formed in one of the access cover lugs. The spring is thus wound so that the access cover is normally biased in the closed position against the mounting member. The mounting member includes a pair of parallel, spaced apart support walls between which the knuckle is located. One of the aligned apertures is a passageway formed through the knuckle, and the passageway is provided with a spring retention groove for receiving the first end of the torsion spring. One of the aligned apertures in one of the access cover lugs includes a blind hole for receiving the other end of the hinge pin. The other of the aligned apertures in the other access cover lug is a through bore dimensioned to receive the end cap therein once the spring is placed in the retaining slot in the other access cover lug. The end cap is a circular planar member with a central opening formed therein for receiving one end of the hinge pin. The end cap is rigidly connected with the one end of the hinge pin. The end cap includes a pair of tabs extending generally perpendicular from the planar member and partially surrounding a coiled portion of the torsion spring located between the first and second ends of the spring. One of the tabs is provided with an opening for capturing the second end of the spring.

Another aspect of the invention contemplates a power inlet box used in connecting an auxiliary generator with the electrical system of a building. The power inlet box has a mounting member including a knuckle fixed to the power inlet box, and an access member including a pair of spaced apart pivot lugs disposed on each side of the knuckle for movement between a closed position in which the access cover engages the mounting member to prevent access to the power inlet box and an open position providing access to the power inlet box. A hinge pin passes through aligned apertures formed in the mounting member knuckle and the access cover lugs. A torsion spring surrounds the hinge pin and has a first end retained in the mounting member knuckle and a second end disposed outside one of the access cover lugs. An end cap is attached to one end of the hinge pin and has tab structure formed with an aperture for retaining the second end of the spring, and a notched peripheral structure which enables the end cap, the hinge pin and the second end of the spring to be rotated together, such that the spring is wound and the second end of the spring is placed in the retaining slot formed in one of the access cover lugs.

Yet another aspect of the invention contemplates a method of installing a biased, hinged access cover arrangement for a power inlet box used in connecting an auxiliary generator to the electrical system of a building. The method includes the steps of providing a cylindrical hinge pin having two ends; providing a torsion spring having a first end, a coiled portion and a second end; providing a circular end cap having a notched peripheral structure and a pair of diametrically opposed tabs, one of which is formed with an opening; placing the second end of the spring in the tab opening; and passing one end of the hinge pin through the coiled portion of the spring and connecting the one end of the hinge pin to the end cap so that the tabs partially surround the spring coiled portion. The inlet box includes a mounting member having a knuckle formed thereon. A passageway is formed through the knuckle member, and a retention groove is formed in the passageway. The access cover is provided with a pair of spaced apart pivot lugs, and one of the lugs is formed with a blind hole and the other of the lugs is formed with a through bore. The method involves placing the lugs on each side of the mounting member knuckle, such that the blind hole and through bore formed in the lugs are aligned with the knuckle passageway; inserting the other end of the hinge pin through the through bore and the passageway and into the blind hole in one of the pivot lugs as the first end of the spring is inserted in the retention groove, with the second end of the spring being disposed outside the other lug; engaging the peripheral structure of the end cap; and rotating the end cap, the hinge pin and the spring until the second end of the spring is placed in the retaining slot and the end cap is received in the through bore.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIGS. 7–9 are partial end views illustrating the installation of the hinge and torsion spring mounting arrangement;

FIG. 10 is a partial isometric view of the installed hinge pin and torsion spring mounting arrangement shown in FIG. 9; and FIG. 11 is an exploded view of the hinge pin and torsion mounting. arrangement.

DETAILED DESCRIPTION OF THE INVENTION

Figure 1:
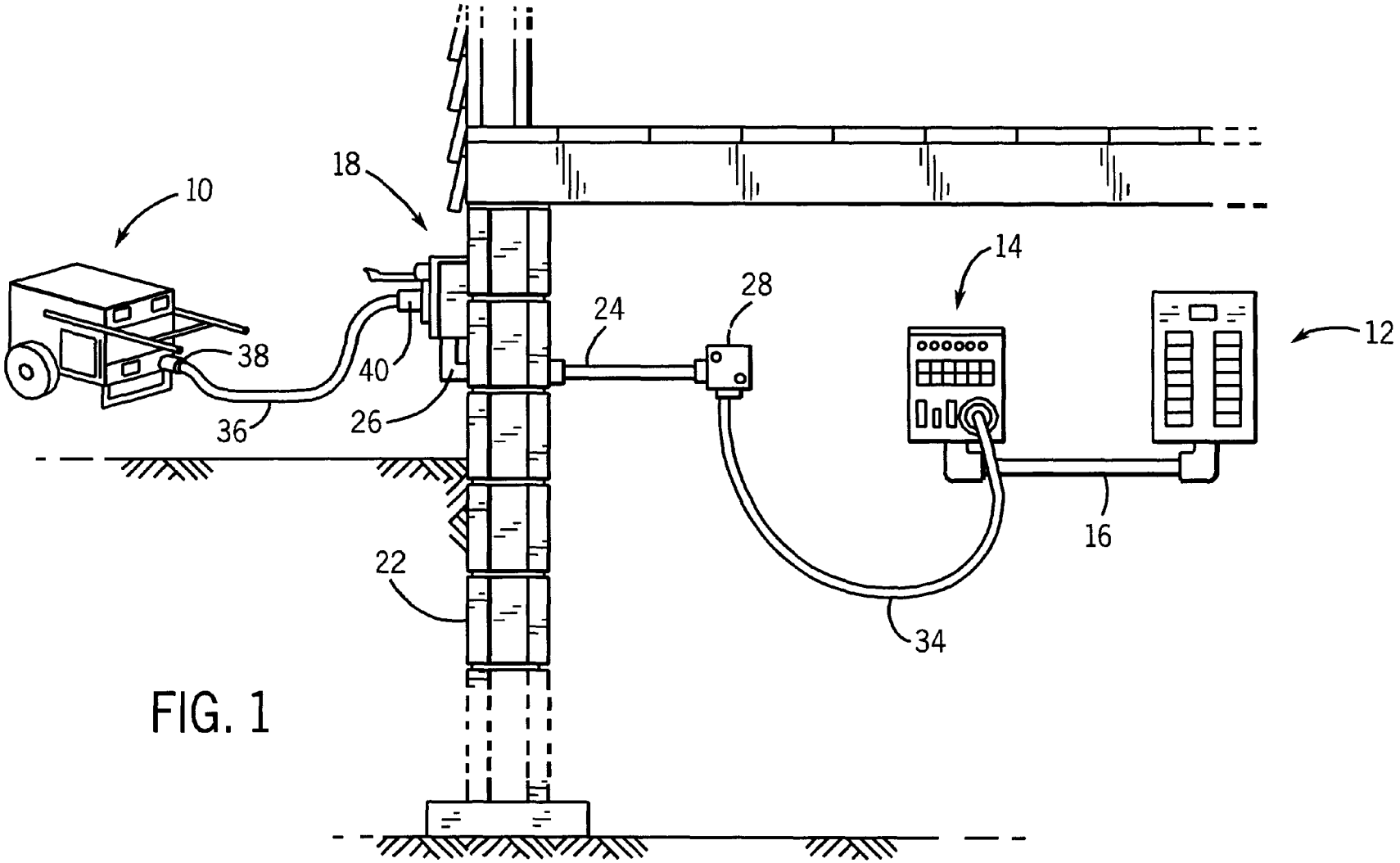
FIG. 1 is a partial section view of a building showing a system for interconnecting a remote power generator with the main electrical panel of the building.

FIG. 1 illustrates a system for interconnecting a remote power generator 10 with the main electrical distribution panel or load center 12 of a building. A manual transfer panel 14 is mounted to the building interior wall adjacent main panel 12 and is connected to main panel 12 via wiring disposed within a conduit 16 extending there-between. Manual transfer panel 14 may be that such as is manufactured by Reliance Controls Corporation of Racine, Wis., under the designation of GEN/SWITCH (e.g. Model 20216 or any other satisfactory model).

A power inlet box 18 is mounted to the exterior of the building wall, shown at 22. A conduit 24 extends from the interior building wall 22 and is interconnected with power inlet box 18 via any satisfactory, conventional wire routing structure, such as an elbow 26 and a nipple extending therefrom and through wall 22 for interconnection with conduit 24. A junction box 28 is mounted to the interior wall of the building, and a flexible cord 34 is attached to junction box 28. Flexible cord 34 has a plug which is engageable with a power inlet receptacle provided at transfer panel 14 to complete the electrical connection between power inlet box 18 and manual transfer panel 14 for supplying power to main panel 12 in the event of a power outage, or the like. Alternatively, cord 34 may be eliminated and a direct, hardwired connection may be made between inlet box 18 and transfer panel 14.

A flexible cord 36 includes a plug 38 at one end which is engageable with the power outlet of generator 10. At its opposite end, cord 36 includes a connector 40 engageable with power inlet box 18 for supplying power to power inlet box 18 from generator 10. When cord 36 is installed in this manner, auxiliary power supplied by generator 10 is transferred to manual transfer panel 14 through inlet box 18 and the wiring in elbow 26, conduit 24, junction box 28 and cord 34 to transfer panel 14. The wiring in conduit 16 transfers power to selected circuits of main panel 12 according to the position of certain switches on transfer panel 14, so as to provide power to such circuits in the event of a power outage.

Figure 2:
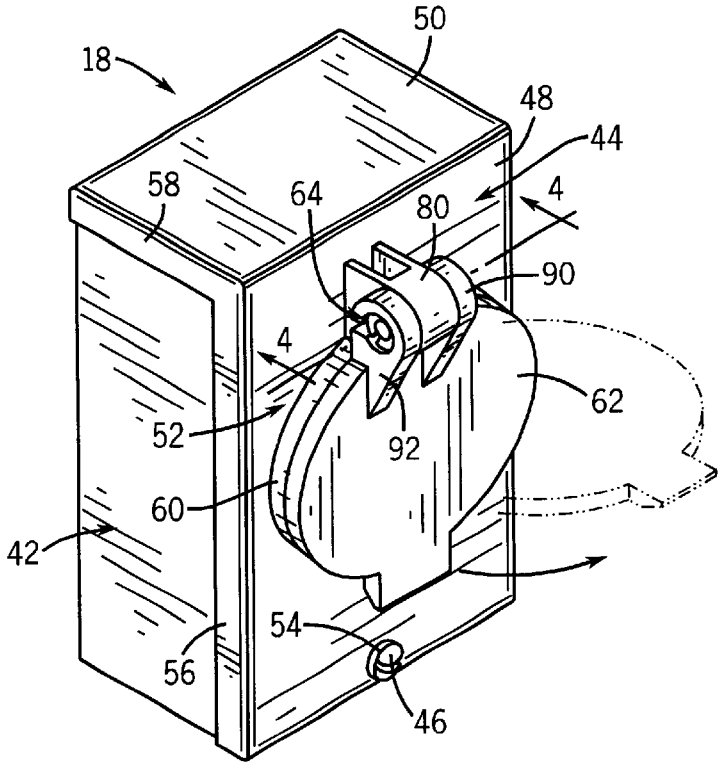
FIG. 2 is an isometric view of a power inlet box incorporated in the system of FIG. 1, in which the inlet box is provided with an access cover hingedly connected to a mounting member.

As shown in FIG. 2, power inlet box 18 generally includes a housing or base member 42 and a cover member 44 which are joined together in a manner fully set forth in above-noted U.S. Pat. No. 5,984,719. A threaded fastener 46, such as a screw, is threadedly engageable with an opening in a bottom wall of base 42. Cover member 44 includes a front wall 48 and a top wall 50 extending rearwardly from the upper end of front wall 48. A power inlet in the form of a power receptacle socket assembly, shown generally at 52, is mounted to front wall 48 and extends through an opening formed therein. A slot 54 extends vertically upwardly from the lower edge of front wall 48.

A pair of side flanges, one of which is shown at 56, extend rearwardly from the side edges of front wall 48 throughout the height of front wall 48. Similarly, a pair of flanges, one of which is shown at 58, extend downwardly from the side edges of top wall 50 throughout the length of top wall 50. A flange similar to flange 58 extends downwardly from the rear edge of top wall 50 between the side flanges.

Figure 3:
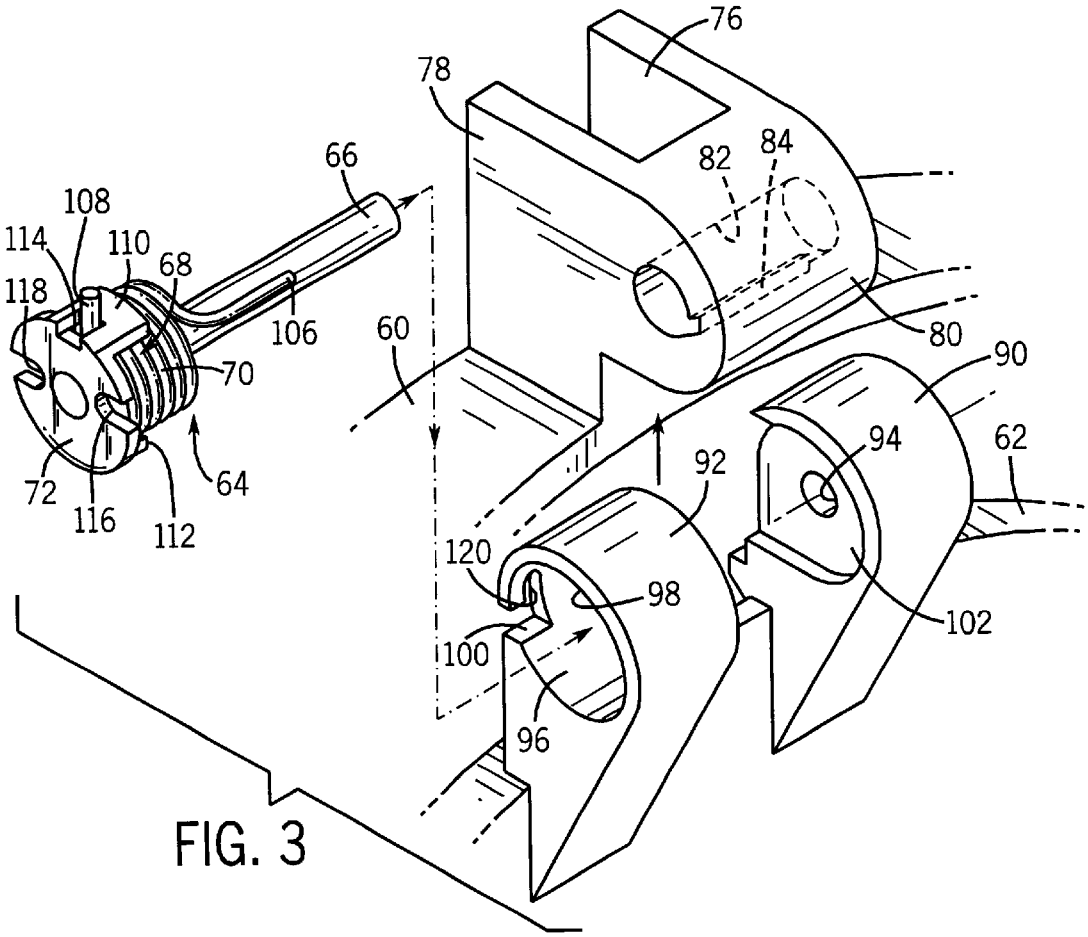
FIG. 3 is an enlarged, exploded view of the power inlet box of FIGS. 1 and 2, showing hinge assembly including a hinge pin and torsion spring mounting arrangement in accordance with the present invention.

In accordance with the invention, the cover member 44 includes a cover arrangement having a mounting member 60 fixed to the front wall 48, and an access cover 62 pivotally attached to the mounting member 60.via a hinge pin and torsion spring mounting arrangement 64 comprised of a generally cylindrical hinge pin 66, a torsion spring 68 with a coiled portion 70, and an end cap 72 with a central opening 74 (FIGS. 3, 11).

Figure 6:
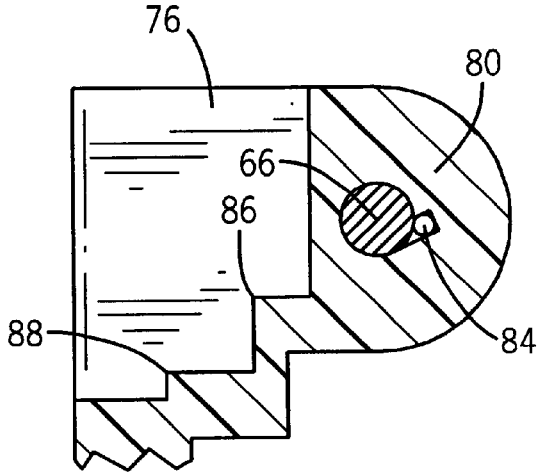
FIG. 6 is a sectional view taken along line 6—6 of FIG. 4.

Mounting member 60 is in the form of a central ring and includes a socket member and receptacle block assembly (not shown) which projects rearwardly from front wall 48, as is well known. As best seen in FIG. 3, the mounting member 60 includes a pair of parallel, spaced apart support walls 76,78 between which a rounded knuckle 80 is integrally formed. The knuckle 80 is formed with a through passage 82 for receiving the hinge pin 66, an axially extending spring retention groove 84 extends outwardly from passage 82, opening onto support wall 78. The knuckle 80 has a pair of stepped portions 86,88 (FIG. 6) which rigidly interconnect the support walls 76,78.

Access cover 62 includes a pair of parallel, spaced apart pivot lugs 90,92 disposed one on each side of the mounting member knuckle 80, and is pivotable between a closed position in which the access cover 62 engages the mounting member 60 to prevent access to the socket member and receptacle block assembly, and an open position (shown in phantom lines in FIG. 2) providing access to the socket member and receptacle block assembly. Pivot lug 90 is provided with a blind passage or hole 94 for receiving a distal end of hinge pin 66, and pivot lug 92 is formed with a through bore or passage 96 for accommodating the coiled portion 70 of the torsion spring 68 and the end cap 72 in a manner to be further explained. A wall 98 forming the through bore 96 is provided with a retaining slot 100 for receiving an end of the spring 68. The retaining slot 100 is generally L-shaped (FIG. 3) so as to positively secure the hinge mounting arrangement 64 in place. The inside surface of pivot lug 90 may also be recessed as shown at 102 in order to provide an optional securement for the hinge pin 66.

As seen in FIGS. 3 and 11, the hinge pin 66 has a proximal end 104 which is notched and dimensioned to pass through the coiled portion 70 of spring 68 and fit into the central opening 74 in end cap 72. The hinge pin 66 is designed to pass into aligned passages 82, 94 and 96 in the respective pivot lugs 90,92 and the knuckle 80, and forms a rotational axis about which the access cover 62 pivots.

Figure 4:
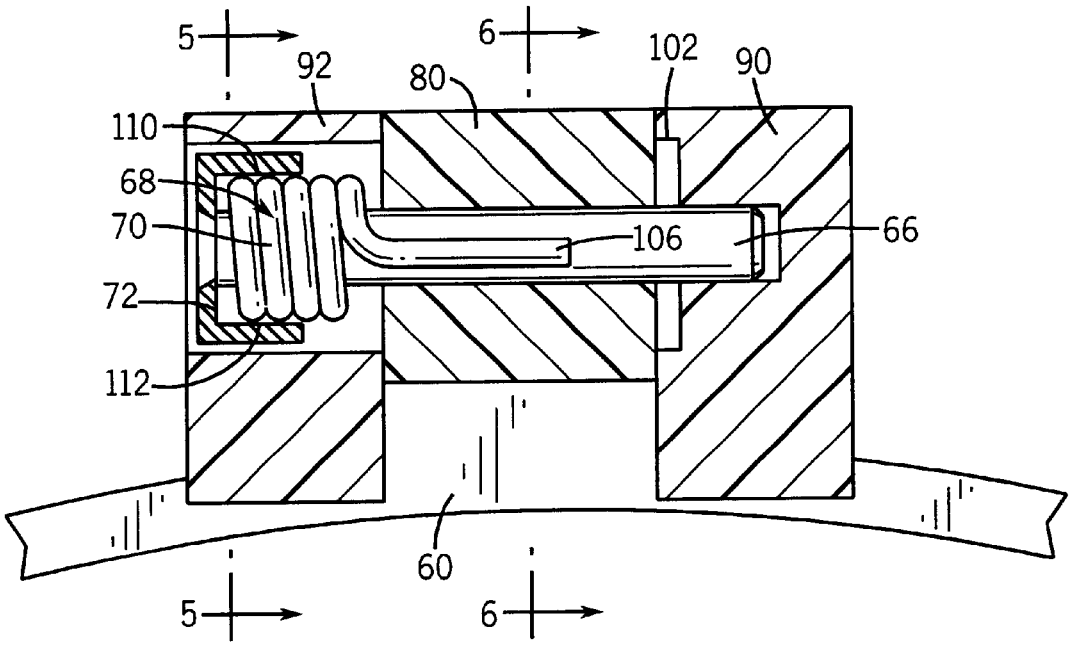
FIG. 4 is a sectional view taken along line 4—4 of FIG. 2.

The coiled portion 70 of torsion spring 68 has a first axially horizontally extending end 106 which is received in the retention groove 84 in the knuckle passageway 82, and is adapted to extend alongside the hinge pin 66 whenthe hinge pin 66 is installed, as shown at FIG. 4. The coiled portion 70 further has a second radially outwardly extending end 108 which is engageable with a portion of the end cap 72 as explained below.

End cap 72 is a circular, planar member formed with central opening 74 and a pair of axially extending tabs 11 0,112 extending generally perpendicularly from planar member at locations diametrically opposite each other. Tab 110 is formed with an opening 114 for receiving the second end 108 of the spring 68. The tabs 110,112 are provided to partially surround the coiled portion 70 of the spring 68, and define bearing surfaces engageable with wall 98 forming the through bore 96 in pivot lug 92 during pivoting of the access cover 62. The tabs 110,112 thus provide centering of the hinge pin 68 so that the pivoting motion of the access cover 62 is smooth and free from binding. The end cap 72 also includes a peripheral structure defined by a pair of diametrically opposed notches 116,118 which facilitate an improved installation of the hinge construction.

To install the hinge construction, hinge pin 66, torsion spring 68 and end cap 72 are assembled together into a subassembly as shown in FIG. 3. The second end 108 of the spring 68 is placed in the opening 114 on tab 110, such that tabs 110,112 partially surround coiled portion 70 of the spring 68. The notched end 104 of the hinge pin 66 is passed through the coiled portion 70 of the spring 68, inserted in the central opening 74 of the end cap 72 and is spun to fuse the end cap 72 to the hinge pin 66. Alternatively, hinge pin 66 and end cap 72 may be integrally formed with each other, which simply requires spring 68 to be assembled such that its second end 108 is inserted through opening 114 after pin 66 is inserted through the coiled portion 70 of spring 68. The resulting product is the hinge pin and torsion spring arrangement 64 shown in FIG. 3. The pivot lugs 90,92 of the access cover 62 are next placed one on each side of the knuckle 80 of the mounting member 60 so that the blind passage 94, the passage 82 and the through passage 96 are all in alignment with each other.

Figure 5:
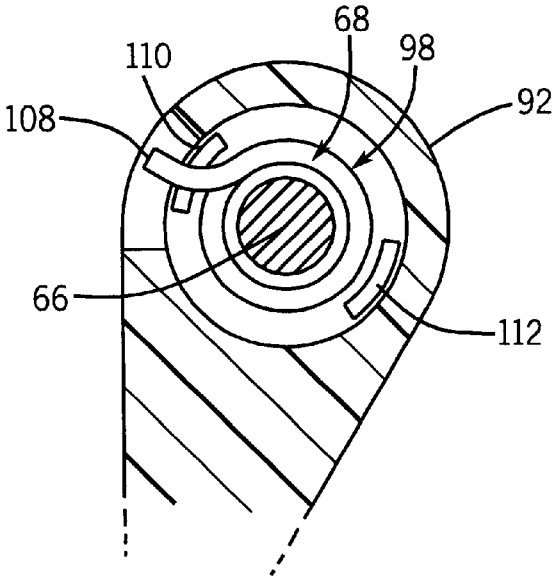
FIG. 5 is a sectional view taken along line 5—5 of FIG. 4.

Holding the end cap 72, the distal end of the hinge pin 66 is inserted through the through passage 96 and the passage 82 and into the blind passage 94 as the first end 106 of the spring 68 is inserted in the retention groove 84 formed in the passage 82. This step is illustrated in FIG. 7, which shows that the second end 108 of the spring 68 is in an upright position disposed outside the pivot lug 92, in engagement with the end surface of pivot lug 92. Using a tool, such as a needle nose pliers, engaged in the notches 116,118, the end cap 721 is rotated approximately 90° counterclockwise in the direction of the arrow until the second end 108 of the spring 68 is brought into registration with the entrance to the retaining slot 100 as depicted in FIG. 8. The end cap 72 is then pushed into the through passage 96 and rotated clockwise into a transverse inner portion 120 of the retaining slot 100 as diagrammatically shown in FIGS. 9 and 10. FIGS. 4 and 5 are sectional views which show the disposition of the components and the finished hinge construction.

When installation,is finished, the spring 68 has been wound such that access cover 62 is normally biased closed against the mounting member 60, so that access to the power inlet box 18 prevented.

Once the hinge construction is installed on front wall 48, the entire cover member 44 is installed on base member 42 according to the '719 patent. When cover member 44 is installed on base member 42 in this manner, slot 54 in the lower edge of front wall 48 receives the shank of screw 46 mounted to the bottom wall in base member 42 (FIG. 2). To secure cover member 44 in position, the user tightens screw 46, such that its head engages cover member 44 adjacent slot 54.

It should thus be appreciated that the present invention, by virtue of the end cap 72 joined to the hinge pin 66 and the peripheral structure of the end cap 72, enables the hinge pin 66, the torsion spring 68 and the end cap 72 to be rotated together as a unit in a manner which improves hinge installation. With the present invention, the hinge pin 66 does not require any retaining ring on its distal end. However, as shown in FIGS. 3 and 4, the pivot lug 90 is recessed at 102 to include a retaining ring, if desired. The present invention thus simplifies assembly of access cover 62 to mounting member 60, in that only a few simple steps are required to engage hinge pin construction 64 with access cover 62 and mounting member 60. The subassembly of hinge pin construction 64 provides significant advantages in providing the biased hinged mounting of access cover 62 to mounting member 60.

While the drawings illustrate use of hinge pin construction 64 to pivotably mount an access cover to a power inlet box, it should be understood that hinge pin construction 64 may be employed in any application in which it is desired to pivotably mount one member to another and to bias the pivoting member to a desired position.

Various alternatives and embodiments are contemplated as being within the scope of the following claims particularly pointing out and distinctly claiming the subject matter regarded as the invention.

I claim:

1. A hinge pin and torsion spring mounting arrangement for pivotably mounting first and second members together, comprising:

a hinge pin adapted to pass into aligned passages formed in the first and second members;

a torsion spring surrounding the hinge pin and having a first end engaged within engagement structure associated with the passage in the first member, and a second end spaced from the first end; and a cap member engaged with the hinge pin and the second end of the spring such that the cap member, the hinge pin and the spring can be moved together such that the second end of the spring is engaged with retaining structure associated with the second member, wherein the spring is wound so that the second member is biased toward the first member, wherein the torsion spring includes a coiled portion received in a recess formed in the second member, wherein the hinge pin has a generally cylindrical shape and includes a notch for receiving the cap member, wherein the cap member has an opening formed therein for receiving the notch of the hinge pin, and wherein the cap member further includes a pair of axial tabs located diametrically opposite each other, one of the tabs having an opening for receiving the second end of the spring, wherein the tabs define bearing surfaces engageable with one wall of the second member for maintaining the hinge pin in a centered position in the aligned passages.

2. The arrangement of claim 1, wherein the tabs partially surround the coiled portion of the spring.

3. The arrangement of claim 1, wherein the cap member as a peripheral structure formed with a pair of diametrically opposed notches adapted to be engaged by a tool to facilitate rotation of the cap member, the hinge pin and the spring.

4. A pivot connection for pivotably mounting a first member to a second member, comprising:

a knuckle fixed to the member;

a pair of spaced apart pivot lugs on the first member, wherein the pivot lugs are disposed one on each side of the knuckle;

a hinge pin passing through aligned passages in the knuckle and the lugs, and forming a rotational axis about which the first member pivots;

a torsion spring surrounding the hinge pin and having a first end retained in the knuckle and a second end spaced from the first end; and a cap member attached to one end of the hinge pin and having retaining structure for retaining the second end of the spring, wherein the cap member, the hinge pin and the spring can be rotated together as a unit such that the second end of the spring is placed in a retaining slot formed in the second member, the spring being wound so that the first member is normally biased toward the second member, the cap member having axially extending tab structure defining bearing surfaces engageable with an internal wall on one of the pivot lugs for maintaining the hinge pin in a centered position in the aligned passages, and wherein the passage formed in the knuckle includes a spring retention slot for receiving the first end of the torsion spring.

5. The hinge construction of claim 4, wherein the second member includes a pair of parallel, spaced apart support walls between which the knuckle is located.

6. The hinge construction of claim 4, wherein the passage in one of the lugs comprises a blind passage for receiving the other end of the hinge pin.

7. The hinge construction of claim 4, wherein the aligned passage in the other access cover lug comprises a through passage dimensioned to receive the cap member therein.

8. The hinge construction of claim 4, wherein the cap member comprises an end cap in the form of a circular planar member with a central opening formed therein for recieving an end of the hinge pin.

9. The hinge construction of claim 8, wherein the end cap is rigidly connected with the hinge pin.

10. The hinge construction of claim 9, wherein the tab structure includes a pair of tabs extending generally perpendicularly from the planar member and partially surrounding a coiled portion of the torsion spring located between the first and second ends of the spring.

11. The hinge construction of claim 10, wherein one of the tabs is provided with an opening for capturing the second end of the spring.

12. In a power inlet box used in connecting an auxiliary generator to the electrical system of a building and having a mounting member including a knuckle fixed to the power inlet box, an access cover including a pair of spaced apart, pivot lugs disposed on each side of the knuckle for movement between a closed position in which the access cover engages the mounting member to prevent access to the power inlet box, and, an open position providing access to the power inlet box, the improvement comprising:

a hinge pin passing through aligned passages formed in the mounting member knuckle and the access cover lugs;

a torsion spring surrounding the hinge pin and having a first end retained in the mounting member knuckle and a second end spaced from the first end; and an end cap secured to one end of the hinge pin and having a tab structure formed with an aperture for retaining the second end of the spring, the tab structure including a pair of axial tabs located diametrically opposite each other, and defining bearing surfaces engageable with an internal surface on one of the pivot lugs for maintaining the hinge pin in a centered position in the aligned passages, one of the tabs having an opening for receiving the second end of the spring, wherein the second end of the spring is adapted to be placed in a retaining slot formed in one of the access cover lugs, the spring being wound so that the access cover is normally biased in the closed position against the mounting member.

13. A method of installing a biased, hinged cover arrangement for a power inlet box used in connecting an auxiliary generator to an electrical system of a building, the method comprising the steps of:

(a) providing a cylindrical hinge pin having two ends;

(b) providing a torsion spring having a first end, a coiled portion and a second end;

(c) providing an end cap having a notched, peripheral structure and a pair of diametrically opposed tabs, one of which is formed with an opening;

(d) placing the second end of the spring in the tab opening;

(e) providing a mounting member having a knuckle formed therein with a passageway therethrough and a retaining slot formed in the passageway;

(f) providing an access cover having a pair of spaced apart pivot lugs, one of the lugs being formed with a blind hole and the other of the lugs being formed with a through bore;

(g) disposing the lugs on each side of the mounting member knuckle such that the blind hole and the through bore formed in the lugs are aligned with the passageway in the knuckle;

(h) passing one end of the hinge pin through the coiled portion of the spring and connecting the hinge pin to the end cap so that the tabs partially surround the spring coiled portion;

(i) inserting the hinge pin through the through bore and the passageway and into the blind hole in the pivot lug as the first end of the spring is inserted in the retention slot; and (j) engaging the peripheral structure of the end cap and rotating the end cap, the hinge pin and the spring until the second end of the spring is placed in the retaining slot and the cap is received in the through bore.

14. A pivot connection for pivotably mounting a first member to a second member, comprising:

a knuckle fixed to the second member;

a pair of spaced apart pivot lugs on the first member, wherein the pivot lugs are disposed one on each side of the knuckle;

a hinge pin passing through aligned passages in the knuckle and the lugs, and forming a rotational axis about which the first member pivots;

a torsion spring surrounding the hinge pin and having a first end retained in the knuckle and a second end spaced from the first end; and a cap member attached to one end of the hinge pin and having retaining structure for retaining the second end of the spring, wherein the cap member, the hinge pin and the spring can be rotated together as a unit such that the second end of the spring is placed in a retaining slot formed in the second member, the spring being wound so that the first member is normally biased toward the second member, wherein the cap member comprises an end cap in the form of a circular planar member with a central opening formed therein for receiving an end of the hinge pin, wherein the end cap is rigidly connected with the hinge pin, and wherein the end cap includes a pair of tabs extending generally perpendicularly from the planar member and partially surrounding a coiled portion of the torsion spring located between the first and second ends of the spring.

* * * * *